US005629664A

United States Patent [19]

Muramatsu et al.

[11] Patent Number: 5,629,664

[45] Date of Patent: May 13, 1997

[54] BLADE FUSE WITH BIFURCATED GRIPPING PIECES

[75] Inventors: Kenji Muramatsu; Toshiharu Kudo, both of Shizuoka, Japan

[73] Assignee: Yazaki Corporation, Tokyo, Japan

[21] Appl. No.: 531,961

[22] Filed: Sep. 21, 1995

[30] Foreign Application Priority Data

Sep. 27, 1994 [JP] Japan ..... 6-231635

[51] Int. Cl.[6] ..... H01H 85/02; H01H 85/143; H01H 85/36

[52] U.S. Cl. ..... 337/261; 337/198; 337/201; 337/190

[58] Field of Search ..... 337/260, 261, 337/262, 198, 216, 208, 201, 190, 186; 29/623; 439/622

[56] References Cited

U.S. PATENT DOCUMENTS

| | | | |
|---|---|---|---|
| 3,909,767 | 9/1975 | Williamson | 337/264 |
| 4,224,592 | 9/1980 | Urani | 337/198 |
| 4,344,060 | 8/1982 | Ciesemier | 337/260 |
| 4,604,602 | 8/1986 | Borzoni | 337/264 |
| 4,661,793 | 4/1987 | Borzoni | 337/260 |
| 4,670,729 | 6/1987 | Oh | 337/264 |
| 5,239,282 | 8/1993 | Filomia | 337/255 |

FOREIGN PATENT DOCUMENTS

| | | | |
|---|---|---|---|
| 1-45174 | 10/1989 | Japan | H01H 85/56 |

*Primary Examiner*—Michael W. Phillips
*Assistant Examiner*—Stephen T. Ryan
*Attorney, Agent, or Firm*—Sughrue, Mion, Zinn, Macpeak & Seas

[57] ABSTRACT

Bifurcated gripping pieces, each having a clearance in a thickness direction of a terminal, are projected from inner edge portions of respective terminals so as to confront each other. An inserting opening of an inserting space is made on a lower surface of a housing. Closing plates interposed between a pair of slits extending in a terminal inserting direction from the inserting opening are arranged on both lateral walls of the housing. The pair of closing plates are gripped between the respective gripping pieces while inserted into the clearances of the respective gripping pieces with the terminals inserted into the inserting space.

5 Claims, 3 Drawing Sheets

BLADE FUSE WITH BIFURCATED GRIPPING PIECES

BACKGROUND OF THE INVENTION

The invention relates to a blade fuse formed by assembling a fuse element into a housing, the fuse element interposing a fusible portion between a pair of flat metal terminals.

A blade fuse (hereinafter referred to as "the fuse") has a fuse element (hereinafter referred to as "the element") formed by interposing a fusible portion between a pair of flat metal terminals (hereinafter referred to as "the terminals") and is assembled with the base end portion of the element (the base end portion being an end portion having the fusible portion formed thereon) accommodated in a housing. Such a blade fuse addresses the problem that the fusible portion that is not rigid is susceptible to deform or break due to external force applied to the terminals.

An exemplary blade fuse that has overcome such a problem is disclosed in Japanese Patent Examined Publication No. Hei. 1-45174. This blade fuse will be described with reference to FIGS. 5 to 7. FIG. 5 is an exploded perspective view showing the conventional fuse before being assembled; FIG. 6 is a perspective view shoeing the conventional fuse as assembled, part of which is depicted in phantom line; and FIG. 7 is an enlarged view showing a hinge portion for forming a continuous flap.

A fusible portion 5 is interposed between terminals 3*a* and 3*b* of an element 1. The fusible portion 5 connects the terminals 3*a* and 3*b* to each other electrically and constructively. Since the fusible portion 5 has a predetermined sectional area, it is difficult to give the fusible portion 5 a rigidity exceeding a predetermined value.

On the other hand, a flap 9 is arranged in the middle of an inserting opening of a housing 7 into which the terminals 3*a* and 3*b* are inserted. The flap 9 is formed continuously to the housing 7 through a thin-walled hinge 11 (see FIG. 7) with the base end of the flap 9 capable of turning.

In the thus constructed conventional fuse 13, the operation of assembling the element 1 to the housing 7 is performed in the following manner. The base end portion of the element 1 is inserted into the housing 7, and this causes the flap 9 to turn. Through this turn, the flap 9 is retained by projections 15 formed on the terminals 3*a* and 3*b* to be fixed between the terminals 3*a* and 3*b*. As a result, the fuse 13 is assembled with the terminals 3*a* and 3*b* held in the housing 7, preventing external force from concentrating on the fusible portion 5.

Thus, according to the conventional fuse 13, the external force can be borne by the flap 9. This does not allow the external force to concentrate on the fusible portion 5, thus preventing the fusible portion 5 from being deformed or broken by the external force.

However, since the flap 9 that prevents deformation or breakage of the fusible portion 5 is formed continuously to the housing 7 through the thin-walled hinge 11 in the conventional fuse 13, the rigidity of the flap 9 is poor. As a result, the terminals 3*a* and 3*b* cannot be fixed reliably. In addition, the formability of the thin-walled hinge 11 is not satisfactory, which impairs productivity. Moreover, the fixing of the terminals using the flap 9 requires the additional step of causing the flap 9 to be retained by the projections 15 while turning the flap 9 after the element 1 has been inserted into the housing 7. This makes the assembling operation cumbersome.

SUMMARY OF THE INVENTION

The invention has been made in view of the aforementioned circumstances. The object of the invention is, therefore, to provide a fuse that allows the terminals to be held with a high degree of rigidity, and permits not only easy forming but also simple assembling, so that the reliability, productivity, and assembling operability can be improved.

To achieve the above object, the invention provides a fuse including: an element; and a housing for accommodating the element. The element includes: a pair of terminals parallel to each other; a fusible portion provided between the terminals; and a pair of bifurcated gripping pieces projected from inner edge portions of the terminals so as to confront each other, each of the bifurcated gripping pieces having a clearance in a thickness direction of the terminal. Further, the housing includes: both lateral walls forming an inserting space into which base end portions having the fusible portion of the terminals are to be inserted; and a pair of closing plates provided in the both lateral walls and interposed between a pair of slits extending in a terminal inserting direction from an inserting opening of the inserting space, wherein the pair of closing plates are gripped from outside by the clearances of the gripping pieces while the terminals are inserted into the inserting space.

DETAILED DESCRIPTION OF THE PREFERRED EMBODIMENT

A fuse, which is a preferred embodiment of the invention, will now be described with reference to the drawings.

Figure 1:
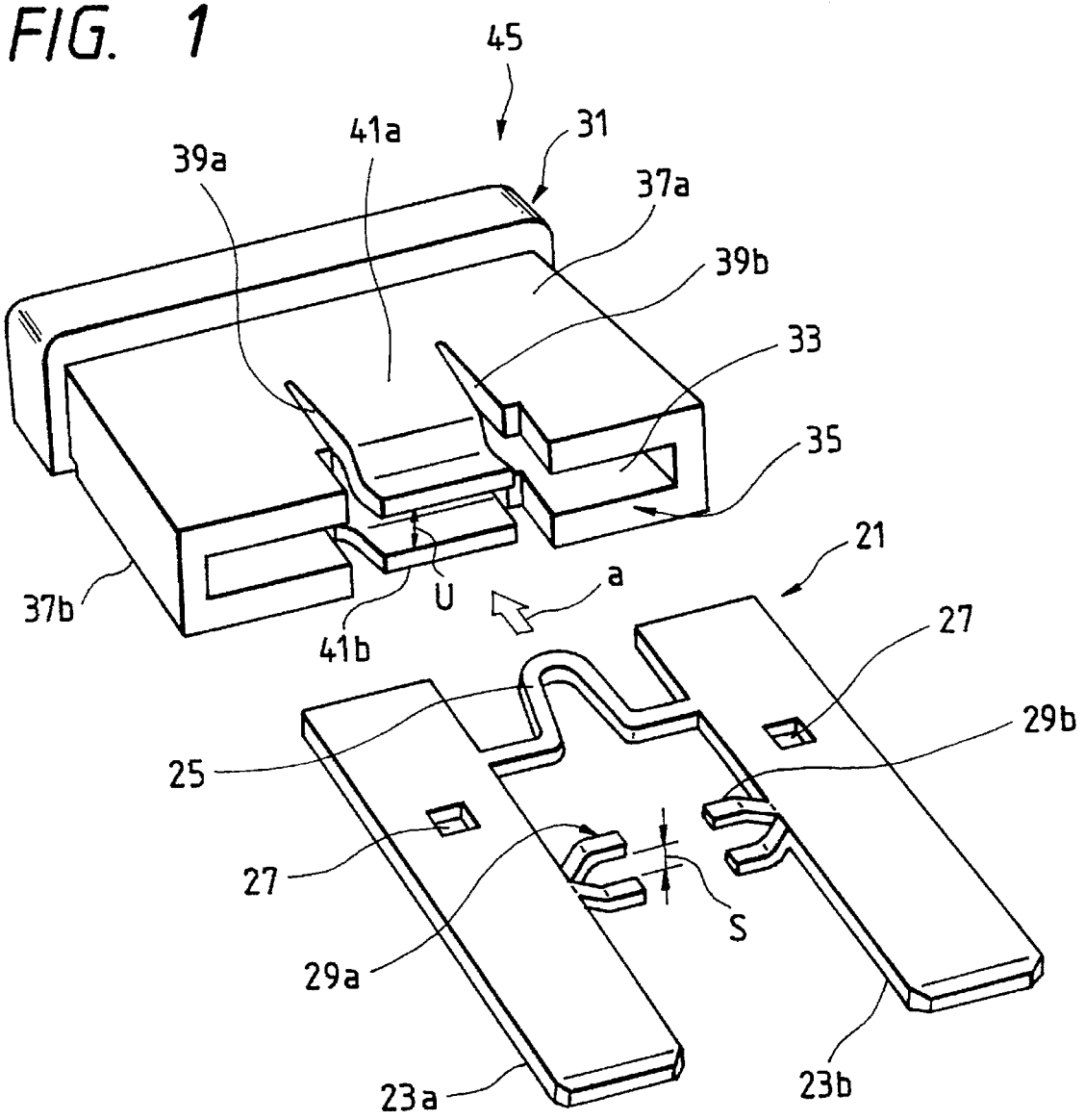
FIG. 1 is an exploded perspective view showing a fuse of the invention before being assembled.
Figure 2:
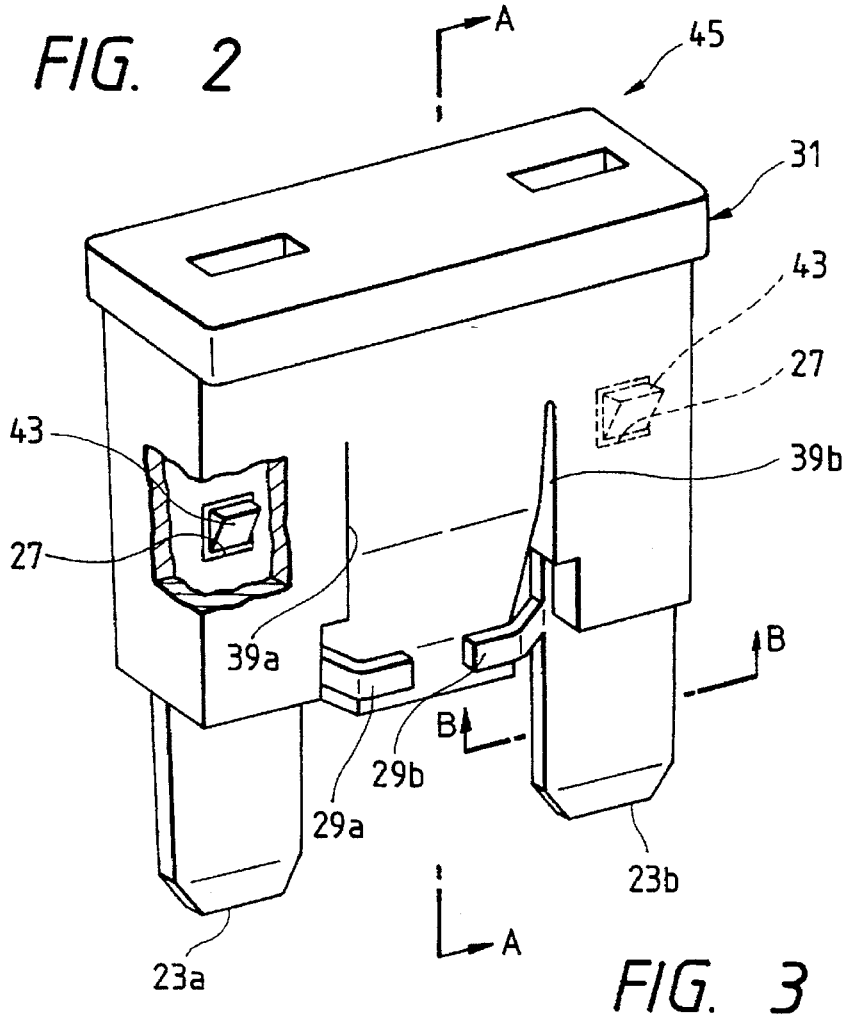
FIG. 2 is a perspective view showing the fuse of the invention as assembled.
Figure 3:
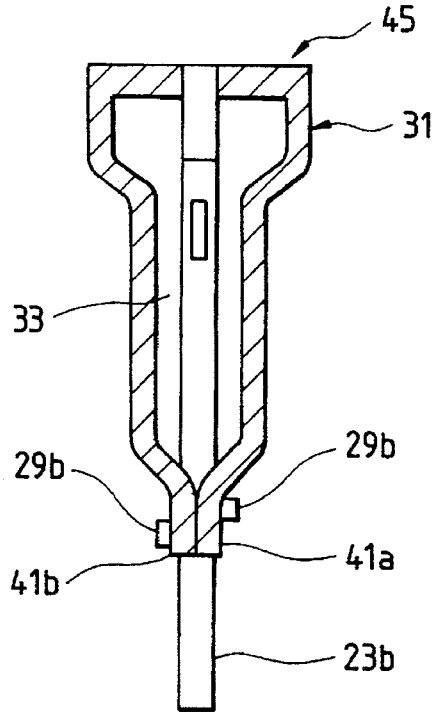
FIG. 3 is a sectional view taken along a line A—A of FIG. 2.
Figure 4:
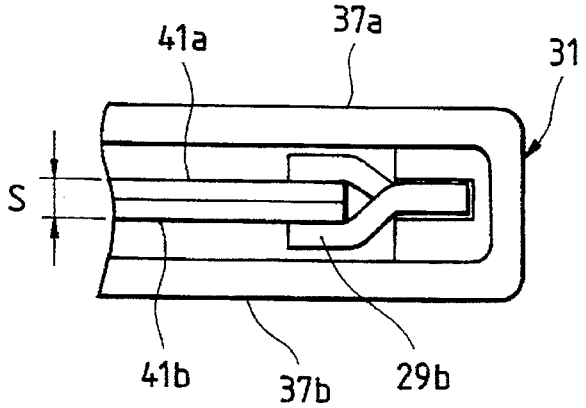
FIG. 4 is a view taken along a line B—B of FIG. 2.
Figure 5:
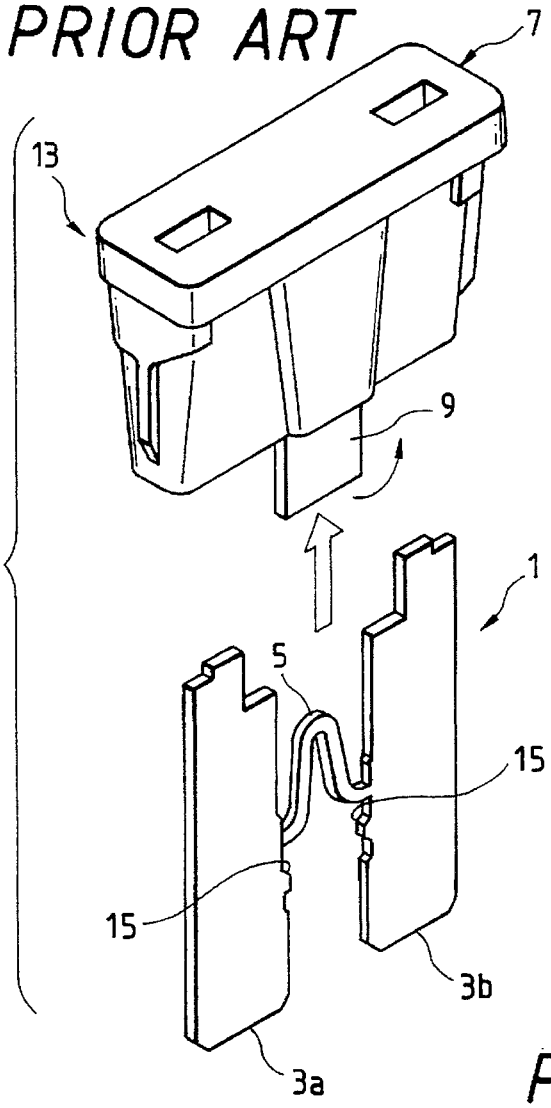
FIG. 5 PRIOR ART
FIG. 5 is an exploded perspective view showing a conventional fuse before being assembled.
Figure 6:
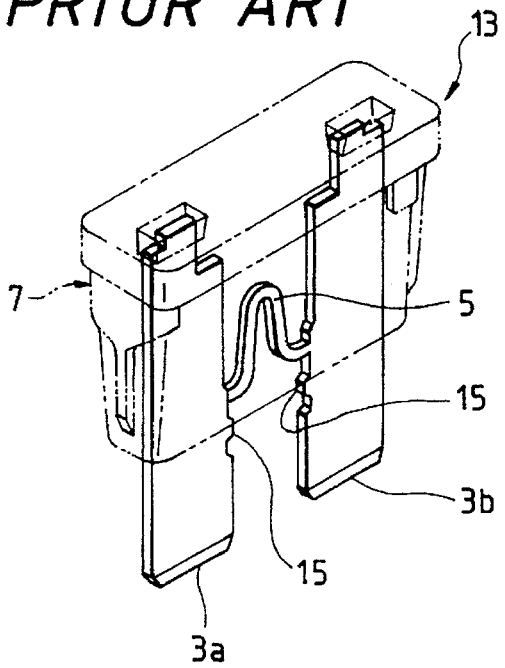
FIG. 6 PRIOR ART
FIG. 6 is a perspective view showing the conventional fuse as assembled, part of which is depicted in phantom line.
Figure 7:
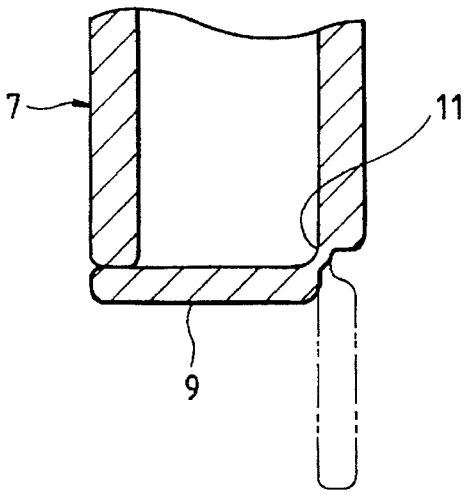
FIG. 7 PRIOR ART
FIG. 7 is an enlarged view showing a hinge portion for forming a continuous flap.

FIG. 1 is an exploded perspective view showing a fuse of the invention before being assembled; FIG. 2 is a perspective view showing the fuse of the invention as assembled; FIG. 3 is a sectional view taken along a line A—A of FIG. 2; and FIG. 4 is a view taken along a line B—B of FIG. 2.

As shown in FIG. 1, a fusible portion 25 is interposed between terminals 23*a* and 23*b* of an element 21. The fusible portion 25 connects the terminals 23*a* and 23*b* to each other electrically and constructively. The terminals 23*a* and 23*b* have retaining holes 27 formed therein, the retaining holes serving as engaging means. The retaining holes 27 are designed to be engaged with retaining projections within a housing as will be described later.

A pair of gripping pieces 29*a* and 29*b* are formed on inner edge portions of the terminals 23*a* and 23*b*, the inner edge portions confronting each other. Each of the gripping pieces 29*a* and 29*b* is bifurcated and has a clearance S in the thickness direction of the terminal. The gripping pieces 29*a* and 29*b* can be formed by arranging projected portions (not shown) on the inner edge portions of the terminals 23*a* and 23*b*, slitting the projected portions in a direction orthogonal to the terminal inserting direction a, and bending the small pieces formed by slitting both toward the front surface of the terminal and toward the back surface of the terminal. It may be noted that any method can be taken to form the gripping pieces 29*a* and 29*b* as long as each of the gripping pieces is bifurcated so as to have the clearance S.

On the other hand, an inserting space 33 into which the base end portions of the terminals 23*a* and 23*b* and the fusible portion 25 are inserted is formed within a housing 31 made of resin or the like. The inserting space 33 has an opening on the lower surface of the housing 31 as an element inserting opening 35.

A pair of slits 39*a* and 39*b* extending in the terminal inserting direction a from the element inserting opening 35 are formed in both lateral walls 37*a* and 37*b* of the housing 31. Between the slits 39*a* and 39*b* are closing plates 41*a* and 41*b*. Only the base ends of the closing plates 41*a* and 41*b* are continuous to both lateral walls 37*a* and 37*b*. The front ends of the closing plates 41*a* and 41*b* normally provides such a clearance u as to allow the fusible portion 25 to be inserted thereinto. Further, the closing plates 41*a* and 41*b* have flexibility and, if biased from outside the lateral walls, overlap one upon the other with the front ends thereof coming in contact with each other. The thickness of the closing plates 41*a* and 41*b* in the overlapped state, the thickness being between the front ends thereof, is equal to the clearance S of each of the gripping pieces 29*a* and 29*b*.

Retaining projections 43, i.e., a pair of engaging means, are formed in the inserting space 33 of the housing 31 (see FIG. 2). The retaining projections 43 are engaged with the retaining holes 27 of the terminals 23*a* and 23*b* when the element 21 is inserted to a predetermined position.

How such a fuse 45 constructed of the element 21 and the housing 31 is operated will be described next.

At the time the element 21 is inserted, the clearance u that allows the fusible portion 25 of the element 21 to be inserted thereinto is provided between the front ends of the closing plates 41*a* and 41*b*. Under this condition, the base end of the element 21 is inserted into the element inserting opening 35, and the fusible portion 25 is also inserted into the inserting space 33 while passing through the clearance u formed between the front ends of the closing plates 41*a* and 41*b*.

When the closing plates 41*a* and 41*b* are biased from outside both lateral walls after the fusible portion 25 has passed between the front ends of the closing plates 41*a* and 41*b*, the front ends of the closing plates 41*a* and 41*b* come to overlap one upon the other to set the total thickness of both front ends to a thickness S that allows both front ends to be inserted into the clearance of each of the gripping pieces 29*a* and 29*b*.

When the element 21 is further inserted under this condition, the front ends of the closing plates 41*a* and 41*b* become inserted into the clearance S of each of the gripping pieces 29*a* and 29*b*, so that the closing plates 41*a* and 41*b* have the front ends gripped between the gripping pieces 29*a* and 29*b* as shown in FIG. 4.

At this instance, simultaneously therewith, the retaining projections 43 within the inserting space 33 become engaged with the retaining holes 27 of the element 21, so that the element 21 is unreleasably fixed to the housing 31. That is, the element 21 is fixed at such a position as to allow the gripping pieces 29*a* and 29*b* to grip the front ends of the closing plates 41*a* and 41*b*. As a result, the element 21 and the housing 31 are fixed integrally with each other while coupled through the gripping pieces 29*a* and 29*b*, and the closing plates 41*a* and 41*b* and therefore given a predetermined degree of rigidity.

Since the element 21 is given rigidity, external force, when applied, e.g., in such directions as to cause the terminals 23*a* and 23*b* to come closer to each other from outside the element 21, is borne by the closing plates 41*a* and 41*b* through the gripping pieces 29*a* and 29*b*, thus not concentrating on the fusible portion 25. Therefore, in the fuse 45, the fusible portion 25 is neither deformed nor broken by the external force.

Described in the aforementioned embodiment is the exemplary structure in which the front ends of the closing plates 41*a* and 41*b* are brought into contact with each other by biasing the closing plates 41*a* and 41*b* from outside the lateral walls after the fusible portion 25 has passed through the clearance u between the closing plates 41*a* and 41*b*. However, the fuse 45 may be constructed in such a manner that the clearance S of each of the gripping pieces 29*a* and 29*b* is tapered in the terminal inserting direction so that by inserting the closing plates 41 and 41*b* into the tapered clearance in association with the inserting of the element 21, the closing plates 41*a* and 41*b* can be gripped between the clearance S of each of the gripping pieces 29*a* and 29*b* without being biased. Such a structure allows both the inserting of the element 21 and the fixing of the closing plates 41*a* and 41*b* to the gripping pieces 29*a* and 29*b* to be performed by a single operation (e.g., without passing the housing 31 from one hand to the other), thereby further improving the assembling operability.

As described in the foregoing in detail, the fuse of the invention is characterized as projecting the bifurcated gripping pieces from the respective terminals, arranging the closing plates interposed between the pair of slits on both lateral walls of the housing, and gripping the closing plates with the gripping pieces, respectively, with the terminals inserted. Therefore, the terminals and the housing are fixed integrally with each other in the coupled state, which gives the coupled body such rigidity as to allow external force to be borne by the closing plates through the gripping pieces, thus not allowing the external force to concentrate on the fusible portion. As a result, not only the terminals can be retained at a high degree of rigidity, but also easy forming is ensured. In addition, simple assembling is also ensured, which, at the same time, contributes to improving the reliability, productivity, and assembling operability.

What is claimed is:

1. A fuse comprising:

an element; and a housing for accommodating said element, said element comprising:

a pair of terminals parallel to each other;

a fusible portion provided between said terminals; and a pair of bifurcated gripping pieces projected from inner edge portions of said terminals so as to confront each other, each of said bifurcated gripping pieces having a clearance in a thickness direction of said terminal, and said housing comprising:

both lateral walls forming an inserting space into which base end portions having said fusible portion of said terminals are to be inserted; and a pair of closing plates provided in said both lateral walls and interposed between a pair of slits extending in a terminal inserting direction from an inserting opening of the inserting space, wherein said pair of closing plates are gripped from outside by the clearances of said gripping pieces while said terminals are inserted into the inserting space.

2. The fuse according to claim 1, wherein said pair of closing plates are made flexible so that a clearance allowing said fusible portion to pass therethrough is formed between said pair of closing plates and that the clearance can be closed by causing front ends of said pair of closing plates to come closer to each other.

3. The fuse according to claim 1, wherein engaging means for fixing said housing to said terminals when said pair of closing plates are gripped from outside by the clearances of said gripping pieces is provided on said housing and said terminals.

4. The fuse according to claim 3, wherein said engaging means comprises a pair of retaining projections provided on said housing, and a pair of retaining holes provided on said terminals, said retaining holes being engaged with said retaining projections respectively.

5. The fuse according to claim 1, wherein the clearance of each of said gripping pieces is tapered in the terminal inserting direction.

* * * * *